United States Patent [19]

Brekell

[11] 4,148,476

[45] Apr. 10, 1979

[54] CONVEYOR FOR LAMELLAR MATERIAL

[75] Inventor: Helge Brekell, Vaxjo, Sweden

[73] Assignee: AB Svenska Flaktfabriken, Nacka, Sweden

[21] Appl. No.: 865,496

[22] Filed: Dec. 29, 1977

Related U.S. Application Data

[63] Continuation of Ser. No. 682,378, May 3, 1976, abandoned.

[30] Foreign Application Priority Data

May 6, 1975 [DE] Fed. Rep. of Germany ... 7514476[U]

[51] Int. Cl.[2] ..... B65H 29/24

[52] U.S. Cl. ..... 271/194; 271/195; 271/196; 198/689

[58] Field of Search ..... 271/112, 184, 194, 195, 271/196; 198/689; 302/2 R

[56] References Cited

U.S. PATENT DOCUMENTS

| | | | |
|---|---|---|---|
| 1,640,768 | 8/1927 | Gutberlet | 271/194 X |
| 2,138,178 | 11/1938 | Lang | 271/195 X |
| 2,578,779 | 12/1951 | Black | 271/194 X |
| 3,550,964 | 12/1970 | Spyropoulos | 271/195 X |
| 3,613,859 | 10/1971 | Keller | 198/689 X |
| 3,617,054 | 11/1971 | Schilling | 271/184 X |
| 3,633,902 | 1/1972 | Worden | 271/195 UX |
| 3,658,322 | 4/1972 | Martin | 271/184 |
| 3,918,706 | 11/1975 | Craft | 271/195 X |

FOREIGN PATENT DOCUMENTS 2317806 11/1973 Fed. Rep. of Germany ..... 271/195

*Primary Examiner*—Robert W. Saifer
*Attorney, Agent, or Firm*—Howson & Howson

[57] ABSTRACT

A system for conveying gypsum slabs through a slab sorting section, a slab distributing section, a slab drying section and a slab removal section in that order. In the sorting section, suction boxes located above the slab path support the moving slabs, which are moved by rotating rollers acting on the upper surfaces of the slabs and holding the slabs a slight distance below the openings in the suction boxes. Undesired slabs are dropped out by reducing the suction pressure. The distributing section uses a laterally-movable distributing table, suction boxes above the slabs, and blower boxes below the slabs, so that the slabs can be gently dropped into different lateral positions on the distributing table; rollers like those in the sorting section are used to control slab advance. In the drying section, blower boxes are used below the slabs for support and drying; blower boxes may also be used above the slabs in the drying section, and brush-type rollers used to advance the slabs. The drying-section boxes are preferably wedge-shaped, with air supplied from the wider edges. The supply of air to the blower and suction boxes can be selectively turned on and off as the slabs progress along their path.

8 Claims, 8 Drawing Figures

CONVEYOR FOR LAMELLAR MATERIAL

This is a continuation of application Ser. No. 682,378 filed May 3, 1976 and now abandoned.

The present invention relates to a conveyor for lamellar material.

It is already known how gypsum slabs for example, in conjunction with their formation, can be conveyed by means of one or several conveyor belts, especially through a dryer, whereby the slabs are protected by an outer covering, for example of cardboard, and can be relatively easily manipulated. It is even possible in so doing to turn the slabs.

Such previously known conveyors, however, cannot be employed for more sensitive lamellar material, since they will damage this sensitive material. This is especially true for a new type of gypsum without any outer covering, which uses a glass slab equipped with glass fibers, whose fine side can even be provided with a pattern during its formation, which naturally must not be damaged. Turning or normal conveyance of such slabs is naturally not possible without damaging them.

The invention has the object of providing a conveyor which is adapted for the conveyance of very sensitive slabs as, for example, the mentioned gypsum slabs equipped with glass fibers.

Further characteristics and advantages of the invention will become apparent from the following description with reference to the attached drawings, in which.

Figure 1:
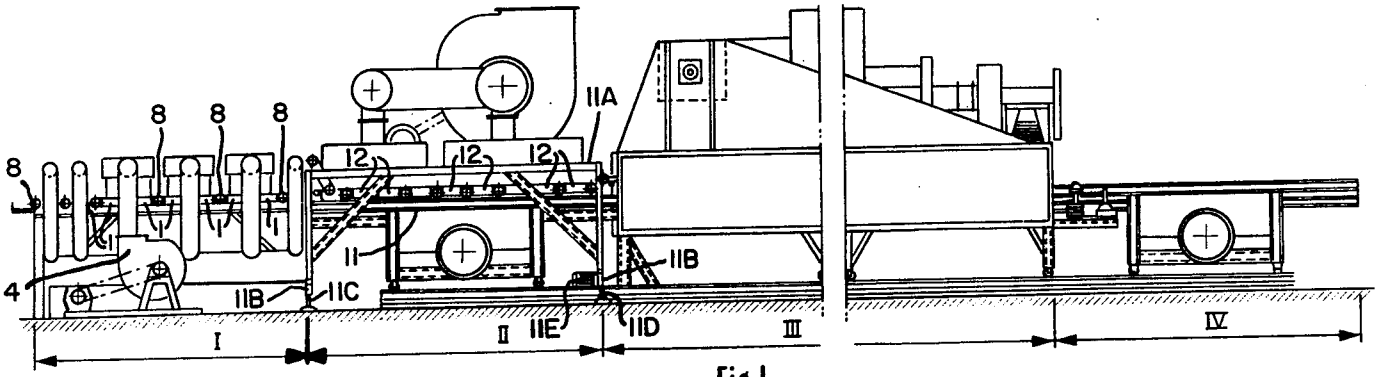
FIG. 1 is a diagrammatic side view of a preferred embodiment of a conveyor for lamellar material, according to the invention.
Figure 2:
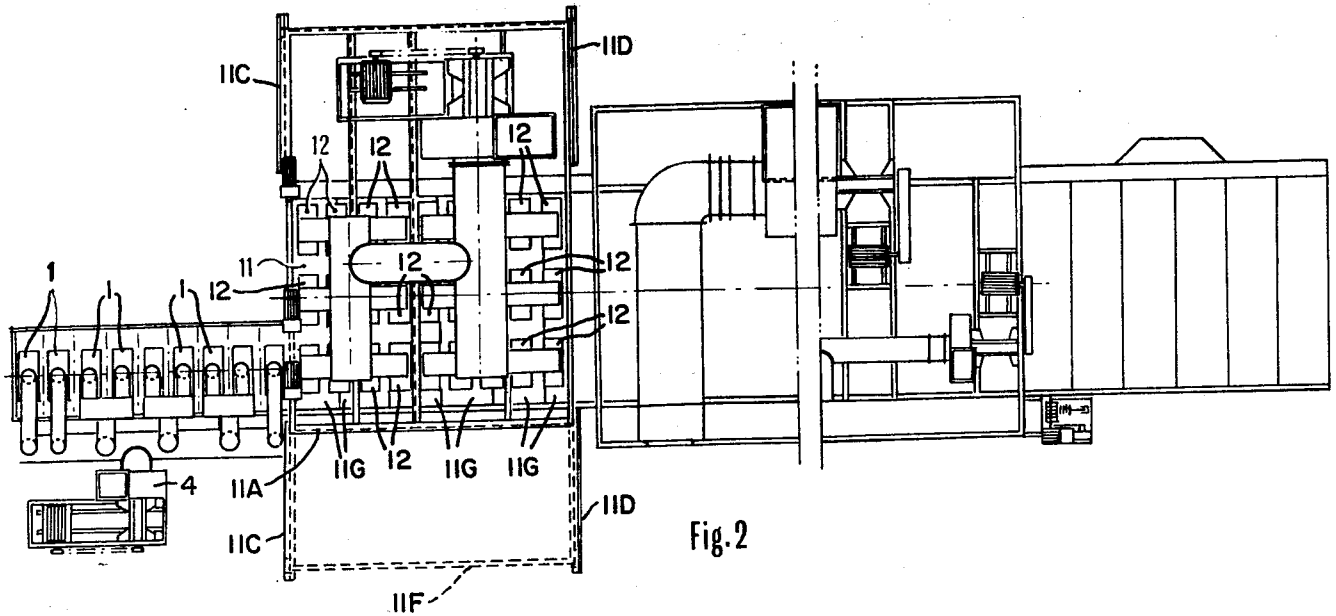
FIG. 2 is a top view of the conveyor of FIG. 1.

The conveyor shown in FIGS. 1 and 2 possesses four main zones, more specifically a receiver zone designated by I, into which the slabs are fed serially a distribution zone II, in which the slabs from the receiver zone are arranged into three parallel laterally-spaced rows, a drying zone III through which the rows of slabs are moved to dry them, and an output zone IV. The general type of support unit shown in FIG. 3 may be used over the zones I and II, with appropriate modifications to suit the particular application. This support unit, which is naturally provided in any desired size, comprises a number of suction boxes 1 extending along and transversely to the conveyance direction, which are perforated on the under side and are arranged horizontally. The suction boxes 1 are preferably attached in groups, through the distribution channels 2 and 3, to a blower 4 which produces a vacuum in the suction boxes 1. The passages between the distribution channels 2 and 3 are preferably alternatively opened and closed by valves 5 or 6, and the main to the blower 4 can be shut off by a valve 7.

Figure 4:
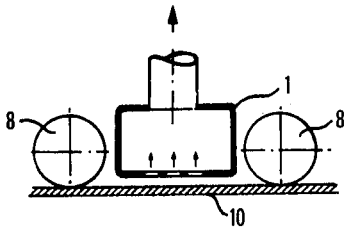
FIG. 4 is a detail view of a part of the unit of FIG. 3 in side view.
Figure 5:
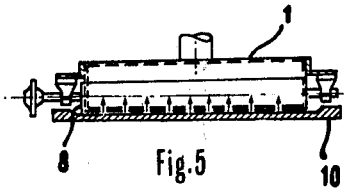
FIG. 5 shows a detail of the unit of FIG. 3, as seen looking along the conveyance direction.

Between the suction boxes 1 there are arranged assist rollers 8 which likewise extend horizontally, and parallel to the suction boxes. The rollers can be driven by a common chain conveyor 9 or the like. As can be seen from FIG. 4, the underside of the assist rollers 8 is located on a somewhat lower level than the underside of the suction boxes 1. In this way, a slab 10 is not pulled tight against the underside of the suction boxes 1, but is always spaced one or a few millimeters away from the suction boxes, while the assist rollers 8 contact the slabs. The small distance between the slab and the suction box ensures, however, a satisfactory holding of the slab, which is thus conveyed forward during this holding by the assist rollers 8.

Figure 3:
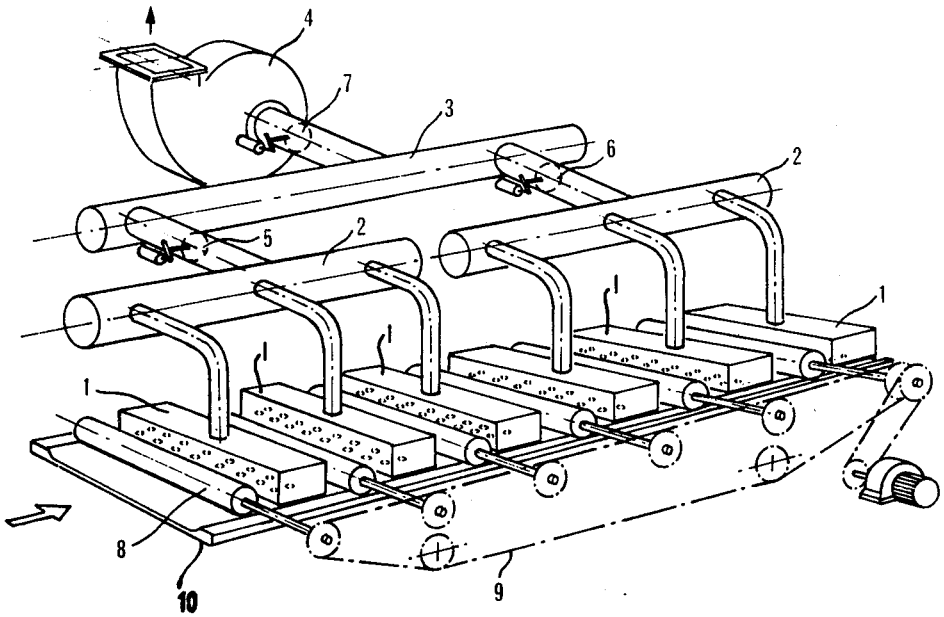
FIG. 3 shows a support unit, in detailed perspective view, of a general type which may be used in section I of FIG. 1.

It can be advantageous, especially when slabs are conveyed at a certain distance from one another along their direction of motion, for example, to open at first only valve 5 with reference to FIG. 3 while valve 6 remains closed. As soon as a slab 10 overlaps, for example, about the half of the suction box group which is activated by valve 6, the valve 6 is opened while valve 5 is closed. In this way, less energy is required to operate blower 4, while retaining otherwise the same advantages. Also certain ventilation problems and so forth can be avoided by doing this. It can be advantageous to combine adjacent suction boxes of two groups with one another, or if necessary to alternate them so that an advantageous passage between the individual groups results. Naturally, photo cells or limit switches can also be arranged at different locations by which, for example, only the suction boxes located over a particular slab are put under a vacuum.

In zone I the space below the suction boxes 1 is completely open, which also permits a further type of operation whereby for example, damaged slabs can be separated. In this operation only the main valve 7 is operated, so that the vacuum in the suction boxes 1 is reduced and the slab falls into an opening or the like (not shown) as a result of its weight, for removal and possibly for a repeated material use.

In the zone designated by II the slabs are also conveyed in the general fashion illustrated in FIG. 3. In this zone, however, at least one distribution table is located under the suction boxes. This table permits the admission of three slabs next to one another, laterally. In the example shown in FIGS. 1 and 2, the relative motion between table 11 and the suction boxes 12 is provided by leaving the table fixed and moving the suction-box supporting table 11A laterally, by means of wheels such as 11B rolling on transverse rails such as 11C, 11D, in response to operation of motor 11E, between the positions shown in full line in FIG. 2 and the position shown in broken line at 11F of FIG. 2, the motion being controlledly arrested at appropriate lateral positions of the suction box array to deposit the slabs in the desired laterally spaced-apart positions shown in FIG. 2, above the blower boxes 11G. However, it will be understood that the desired relative motion may, for example, in some cases be provided by lateral motion of the distribution table alone.

When the slabs are located in the desired position over the lateral distribution table, then valve 7 or other corresponding valves are closed, for example, so that the suction effect is reduced or ceases altogether and the slabs descend on to the distribution table. The distribution table 11 has a perforated upper side, for example in the form of a number of blower boxes 11G, whereby air is blown under the descending slabs, which do not touch the distribution table at any stage, but are held suspended over it. To restrain the slabs in a lateral direction, longitudinal guide ridges are provided which can also be continued through zone III and even through zone IV.

Figure 7:
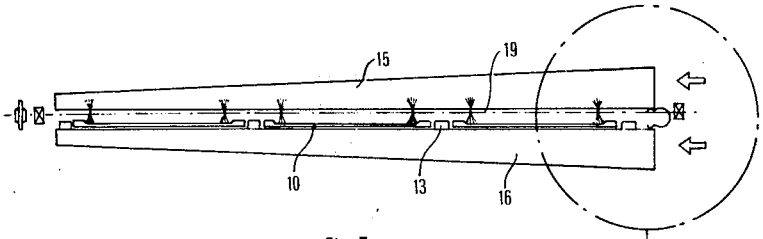
FIG. 7 shows a detail of the unit according to FIG. 6, as seen looking along the conveyance direction.
Figure 8:
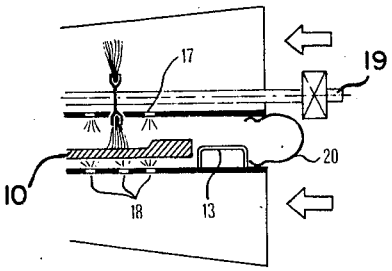
FIG. 8 is an enlarged representation of the part encircled in FIG. 7.

The slabs reach zone III from the distribution table while they are correspondingly pushed forward by pneumatic thrust cylinders 14, for example, the pistons 14A of which are urged outwardly and along the conveyance direction in conventional fashion when supplied with pneumatic pressure to push against the rearward ends of the slabs, as shown. Blower boxes 15 or 16 are located in zone III above as well as below the slabs 10. The sides of the blower boxes 15, 16 turned toward the slabs 10 are provided with perforations 17 or 18. The blower boxes are constructed, in a preferred form, with elongated sections which extend transversely to the conveyance direction, whereby the faces of the upper and lower boxes turned toward each other are horizontal, while the faces thereof turned away from one another converge toward one another from the blower inlet end. The blower air is thus brought in, preferably on a partial basis. The blower boxes can be arranged in groups next to one another. Between the upper blower boxes 15 or groups of the same, conveyor rollers 19 are arranged, which are operated as brush rollers in a preferred embodiment. And a brush wheel can also be adjoined to each longitudinal edge area of a slab, as shown in FIGS. 7 and 8. In this way, a resilient and especially advantageous arrangement, and a faultless conveyance of the slabs, is attained, whereby the brush wheels thus reach the back sides of the slabs while the fine sides of the slabs are turned downwards and float on the air cushion of the lower blower boxes 16.

Figure 6:
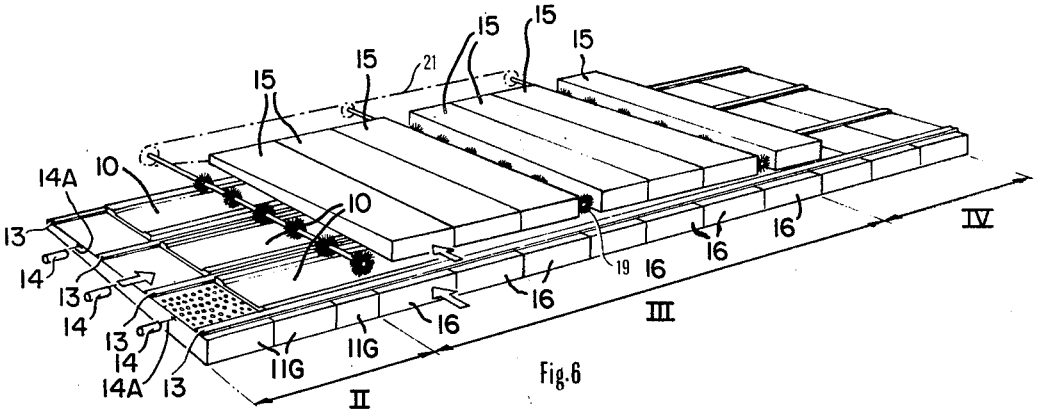
FIG. 6 shows a different support unit according to the invention, in a perspective partial view.

It can be advantageous to cover the slit between the upper and lower blower boxes 15 and 16 at the blower end with an impervious fillet 20, or the like. In this way, an even air outflow from the perforations is largely guaranteed over the total breadth of the conveyance track, in conjunction with the wedge-shaped construction of the blower boxes. As shown in FIG. 6, the brush rollers 19 are driven by a chain conveyor or the like 21.

After passing the drying zone III, the dried slabs reach the removal zone IV, where they are further conveyed in a proper fashion, stored or are treated in a different way.

The preceding described embodiments shown in the illustrated diagrams are only to be considered as non-restricting examples which can be changed or modified at will in the framework of the concept of the invention. Thus it is not absolutely necessary to provide the upper blower boxes 15 in the drying zone III, although their provision does guarantee a more rapid drying. Instead of blower boxes, blower nozzles can also be provided which would naturally become correspondingly more expensive. It is also possible to tilt the nozzles or perforations in the blower boxes 16 along the conveyance direction, so that by such an arrangement a certain push on the slabs is attained. The conveyor rollers 19 need not absolutely have brush wheels; instead, a foam-like material cover on the rollers can, for example, be used, or wheels or rollers of foam-like material or of a corresponding material can be used. Also the guiding ridges 13 can be eliminated when relatively densely arranged conveyor rollers 19 with brush rollers or the like are used, as in FIG. 7, since a certain guidance is already guaranteed by the brush wheels or the like if the back side of the slab is profiled as shown. Also brush wheels or the like can grasp between the slabs lying next to one another, and can have a larger diameter so that in so doing a guidance as well as a boundary between the slabs can be attained.

Inside the drying zone III, it is naturally advantageous to temper appropriately the air provided for the blower boxes 15, 16, in order to attain the best possible drying during the conveyance.

What is claimed is:

1. In a conveyor system for a train of fragile slabs of lamellar material requiring drying, comprising a slab sorting section, a slab distributing section, a slab drying section, and a slab removal section, in that order, the improvement wherein:

said slab sorting section comprises first suction-box means positioned above and adjacent the upper face of each successive slab in said train for supporting it from above, means acting on the upper surfaces of said slabs to move them onward to said distributing section, and means for controlledly reducing the suction applied to said slab by said first suction-box means to a level for which said slab will fall from said train when it is desired to remove it from said train;

said slab distributing section comprises second suction-box means positioned above and adjacent the upper face of said each slab for supporting it from above, means for controlledly reducing the suction applied to said each slab by said second suction-box means to a level for which said each slab is released by said second suction-box means, a distributing table beneath said slabs, means for providing relative lateral motion between said table and said suction-box means to receive said slabs at different lateral positions thereon when said slabs are released by said second suction-box means, first blower-box means acting upwardly through said table to support and cushion said slabs received by said table, and means for urging said received slabs into said drying section; and said drying section comprises second blower-box means acting upwardly from beneath said slabs to support them on air from said second blower-box means, and means for moving said dried slabs from said drying section to said removal section.

2. The system of claim 1, wherein said suction box means comprise a plurality of separate suction boxes, said system comprising air-moving means for generating flows of blower and suction air and conduit means connecting said air-moving means to said blower-box means and to said suction-box means, said conduit means comprising a separate air conduit for each of said suction boxes and a plurality of separate air distribution conduits each connecting a different group of said separate air conduits to said air-moving means, and air valve means for separately controlling the flow of air between each of said air distribution conduits and said air-moving means, whereby the degree of suction applied by different groups of said suction boxes may be varied as said slab moves along beneath different ones of said suction boxes.

3. The system of claim 1, comprising assist rollers disposed transverse to the path of said slabs adjacent said suction-box means, and positioned so that said rollers contact said slabs slightly below the sides of said suction-box means facing said slabs, whereby said rollers assist in moving said slabs along said path while holding them in a position spaced slightly below said suction-box means.

4. The system of claim 3, comprising a common chain drive, driving said rollers at the same speed.

5. The system of claim 1, comprising third blower-box means positioned above the path of said slabs in said drying suction and blowing air downwardly against said slabs to limit the position of the slabs in the upward direction.

6. The system of claim 5, wherein said second blower-box means comprises a first wedge-shaped blower box having a perforated horizontal upper face and an imperforate lower face, and said third blower-box means comprises a second wedge-shaped box having a perforated horizontal lower face and an upper imperforate face, said imperforate faces converging toward each other in a direction transverse to the path of said slabs, said system also comprising air-moving means supplying blower air into the wider side edge of each of said wedge-shaped blower boxes.

7. The system of claim 6, comprising an impervious fillet closing the space between said first wedge-shaped blower box and said second wedge-shaped blower box at said wider side edges thereof.

8. The system of claim 5, wherein said third blower-box means comprises a plurality of blower boxes spaced along the path of said slabs in said drying section, said system also comprising a plurality of conveying rollers extending transversely across said path between said blower boxes and carrying brush wheels which rotate against longitudinal edge areas of said slabs.

* * * * *